US006044241A

United States Patent [19]

Kumar et al.

[11] Patent Number: 6,044,241

[45] Date of Patent: Mar. 28, 2000

[54] DUAL CHARGING AND METERING OF DEVELOPMENT MEMBER

[75] Inventors: Ajay Kumar, Fairport; Dhirendra C. Damji, Webster, both of N.Y.

[73] Assignee: Xerox Corporation, Stamford, Conn.

[21] Appl. No.: 09/141,956

[22] Filed: Aug. 28, 1998

[51] Int. Cl.[7] ..... G03G 15/08

[52] U.S. Cl. ..... 399/284; 399/274

[58] Field of Search ..... 399/222, 265, 399/267, 274, 279, 284, 275

[56] References Cited

U.S. PATENT DOCUMENTS

| | | | |
|---|---|---|---|
| 3,660,863 | 5/1972 | Gerbasi | 15/256.51 |
| 4,194,830 | 3/1980 | Ohnuma et al. | 399/284 |
| 4,348,979 | 9/1982 | Daintrey . | |
| 4,498,756 | 2/1985 | Hosoya et al. | 399/284 |
| 4,523,833 | 6/1985 | Jones . | |
| 4,637,340 | 1/1987 | Thompson et al. . | |
| 4,748,472 | 5/1988 | Mukai et al. | 399/284 X |
| 4,777,904 | 10/1988 | Gundlach et al. . | |
| 4,901,116 | 2/1990 | Haneda et al. . | |
| 4,935,784 | 6/1990 | Shigehiro et al. . | |
| 5,085,171 | 2/1992 | Aulick et al. . | |
| 5,166,733 | 11/1992 | Eliason . | |
| 5,387,963 | 2/1995 | Kajimoto et al. | 399/284 |
| 5,416,567 | 5/1995 | Toyoshima et al. | 399/284 X |
| 5,781,827 | 7/1998 | Shimada et al. | 399/284 X |

*Primary Examiner*—Sandra Brase
*Attorney, Agent, or Firm*—Andrew D. Ryan

[57] ABSTRACT

A developer unit for developing a latent image with marking particles is provided. The developer unit includes a housing defining a chamber for storing a supply of marking particles therein. The developer unit also includes an advancing member for advancing the marking particles on a surface thereof from the chamber of the housing in a first direction toward the latent image. The developer unit also includes a first regulating member for charging the marking particles and for regulating the thickness of the layer of marking particles on the surface of the advancing member. The developer unit also includes a second regulating member spaced from the first regulating member. The second regulating member serves to at least one of charge the layer of marking particles on the surface of the advancing member and regulate the thickness of the layer of marking particles on the surface of the advancing member. The second regulating member is adapted cooperate with the advancing member to charge the marking particles on the surface of the advancing member so as to reduce ghosting when developing the latent image with the marking particles.

20 Claims, 9 Drawing Sheets

DUAL CHARGING AND METERING OF DEVELOPMENT MEMBER

BACKGROUND OF THE INVENTION

This invention relates to electrostatographic reproduction machines, and more particularly to a process cartridge for use in an electrostatographic reproduction machine. Specifically this invention relates to such a cartridge including a printing cartridge with two stage charging and metering of a development member.

Generally, the process of electrostatographic reproduction, as practiced in electrostatographic reproduction machines, includes charging a photoconductive member to a substantially uniform potential so as to sensitize the surface thereof. A charged portion of the photoconductive surface is exposed at an exposure station to a light image of an original document to be reproduced. Typically, an original document to be reproduced is placed in registration, either manually or by means of an automatic document handler, on a platen for such exposure.

Exposing an image of an original document as such at the exposure station, records an electrostatic latent image of the original image onto the photoconductive member. The recorded latent image is subsequently developed using a development apparatus by bringing a charged dry or liquid developer material into contact with the latent image. Two component and single component developer materials are commonly used. A typical two-component dry developer material has magnetic carrier granules with fusible toner particles adhering triobelectrically thereto. A single component dry developer material typically comprising toner particles only can also be used. The toner image formed by such development is subsequently transferred at a transfer station onto a copy sheet fed to such transfer station, and on which the toner particles image is then heated and permanently fused so as to form a "hardcopy" of the original image.

It is well known to provide a number of the elements and components, of an electrostatographic reproduction machine, in the form of a customer or user replaceable unit CRU. Typically such units are each formed as a cartridge that can be inserted or removed from the machine frame by a customer or user. Reproduction machines such as copiers and printers ordinarily include consumable materials such as toner, volume limiting components such as a waste toner container, and life cycle limiting components such as a photoreceptor and a cleaning device. Because these elements of the copying machine or printer must be replaced frequently, they are more likely to be incorporated into a replaceable cartridge as above.

There are therefore various types and sizes of cartridges, varying from single machine element cartridges such as a toner cartridge, to all-in-one electrostatographic toner image forming and transfer process cartridges. The design, particularly of an all-in-one cartridge can be very costly and complicated by a need to optimize the life cycles of different elements, as well as to integrate all the included elements, while not undermining the image quality. This is particularly true for all-in-one process cartridges to be used in a family of compact electrostatographic reproduction machines having different volume capacities and elements having different life cycles.

There is therefore a need for a quality image producing, economical and capacity-extendible all-in-one process cartridge that is easily adapted for use in various machines in a family of compact electrostatographic reproduction machines having different volume capacities and elements with different life cycles.

In single component development as described above, the particle of toner is charged prior to development of the toner onto the photoreceptive drum by rubbing the particle between a charge-metering blade and the magnetic roll. The charged particles on the periphery of the magnetic roll are then transferred onto the photoconductive drum at the charged portions of the surface of the photoconductive drum or the latent image to form the developed image on the photoconductive drum. The developed image is then transferred onto the substrate or paper. In the process of transferring the toner from the surface of the magnetic roll onto the paper, some of the toner remains on the surface of the magnetic roll. The toner, which remains on the surface of the magnetic roll, has a residual charge which may accumulate on the magnetic roll. When the surface of the magnetic roll is exposed to toner from the sump to be reloaded for further image development, the toner which remains on the surface combines with fresh toner from the sump. These accumulated or residual charges are not uniformly distributed on the periphery of the magnetic roll and in fact correspond to the developed image of the photoconductive drum. These accumulated or residual charges on the periphery of the magnetic roll cause less toner to be attracted to the periphery of the magnetic roll at areas which correspond to a concentrated or solid developed image of the photoconductive drum. These accumulated or residual charges may result in ghosting or underdevelopment of an area upon the substrate or paper.

Such ghosting phenomenon is more acute in solid area development where large areas of the substrate are required to have a dark or solid image. In such situations these accumulated or residual charges reduce the amount of fresh toner attracted onto the magnetic roll. This lack of sufficient toner on the magnetic roll result in insufficient toner being transferred to the photoconductive drum for transferring onto the substrate to obtain a proper image on the substrate. This phenomenon may be attributable to the fact that the magnetic roll may not pick up enough toner on areas of the magnetic roll which were previously used for solid area development. Therefore, these areas have a lighter than desired image. This phenomenon is commonly known as ghosting.

The following disclosures may be relevant to various aspects of the present invention:

U.S. Pat. No. 5,166,733

Patentee: Eliason

Issue Date: Nov. 24, 1992

U.S. Pat. No. 5,085,171

Patentee: Aulick, et al.

Issue Date: Feb. 4, 1992

U.S. Pat. No. 4,935,784

Patentee: Shigehiro, et al.

Issue Date: Jun. 19, 1990

U.S. Pat. No. 4,901,116

Patentee: Haneda, et al.

Issue Date: Feb. 13, 1990

U.S. Pat. No. 4,777,904

Patentee: Gundlach, et al.

Issue Date: Oct. 18, 1988

U.S. Pat. No. 4,637,340

Patentee: Thompson, et al.

Issue Date: Jan. 20, 1987

U.S. Pat. No. 4,523,833

Patentee: Jones

Issue Date: Jan. 18, 1985

U.S. Pat. No. 4,348,979

Patentee: Daintrey

Issue Date: Sep. 14, 1982

U.S. Pat. No. 43,660,863

Patentee: Gerbasi

Issue Date: May 9, 1972

U.S. patent application Ser. No. 08/970,313

Applicants: Kumar, et al.

Filing Date: Nov. 14, 1997

U.S. Pat. No. 5,166,733 discloses an electrophotographic printer having a photoreceptor surface for the creation of electrostatic latent images thereon and a rotating roll for conveying toner particles to a development zone adjacent the photoreceptor surface, an apparatus prevents the migration of toner particles from the roll. A blade, in contact with the roll adjacent one end thereof, causes toner particles adhering to an area of the roll to be moved toward the roll center as the roll rotates.

U.S. Pat. No. 5,085,171 discloses a doctor blade having an outer metal surface on a grit layer with flexible backing. The blade is pushed by foam or, alternately by inherent resilience, onto a developer roller. The compliance reduces toner variations which result from surface variations of the blade and the roller.

U.S. Pat. No. 4,935,784 discloses an apparatus for developing a latent image on a photo-sensitive drum which apparatus uses as a developing agent microcapsule toner magnetic particles wherein regulation member contacts the surface of developing agent carrier, or sleeve, under pressure for regulating the thickness of a uniform thin layer of the particles deposited on the sleeve and the contact pressure of the regulation member on the sleeve is not more than 20 g/cm. Preferably, the toner particles have a residual magnetic level not more than 4 emu/g and a magnetic holding force not more than 90 Oe.

U.S. Pat. No. 4,901,116 discloses an electrostatic copier having a smoothing member at an upstream side in the developer conveying direction in the vicinity of a developing area between a developer conveyer and an image-forming member in order to smooth a developer layer on the conveyor prior to transfer of the image forming member. Further, one surface of the smoothing member is so arranged as to come in contact with the image-forming member and another surface smoothes the developer layer. The developer conveyer has a magnet member therein and the magnet member is positioned to face the smoothing portion of the smoothing member.

U.S. Pat. No. 4,777,904 discloses a touchdown development system includes a donor roll positioned closely adjacent a photosensitive member in order to develop an image on the surface of the photosensitive member. A reverse mounted doctor blade is employed in the system along with a toner pump in order to apply a smooth and uniform layer of toner onto the surface of the donor roll.

U.S. Pat. No. 4,637,340 discloses a structure for metering the developer to a uniform thickness on a developer roll. To this end a magnetic steel shim or blade member is provided in the vicinity of a magnetic developer roll. The shape and location of the shim or blade member in the developer sump is such that a transport magnet (i.e. developer roll) rotatably supported adjacent the outlet of the sump causes vibration of the shim or blade due to the coupling and decoupling therebetween of the magnetic force fields created through the rotation of the developer roll. The developer which passes between the shim or blade member and the developer roll is freed of agglomerations and is metered to a predetermined thickness on the developer roll.

U.S. Pat. No. 4,558,943 discloses an apparatus in which a latent image recorded on an image receiving member is developed. A developer roller transports the marking particles into the development zone. The developer roller has the exterior surface thereof roughened forming a multiplicity of peaks extending outwardly therefrom with a coating of polymeric material filling the space between adjacent peaks. A blade is positioned to have the free end thereof contacting the peaks on the developer roller. The blade has a plurality of apertures therein through which the marking particles pass. In this way, the thickness of the layer of marking particles on the developer roller is controlled.

U.S. Pat. No. 4,523,833 discloses an apparatus in which a latent image recorded on an image receiving member is developed. A developer roller transports marking particles into the development zone. A blade having at least one aperture therein through which the marking particles pass has the free end portion thereof contacting the developer roller. A controller regulates the quantity of marking particles passing through the aperture in the blade. In this way, the thickness of the layer of marking particles on the developer roller is adjusted.

U.S. Pat. No. 4,348,979 discloses a magnetic brush monocomponent developer unit includes a doctor blade for rendering uniform the layer of toner magnetically attracted to the surface of a shell within which a rotating magnetic roller is positioned. A coil connected to the doctor blade receives an alternating magnetic field in response to rotation of the roller and the induced voltage fluctuations in that coil are sensed to determine when the voltage amplitude exceeds a given threshold value (indicative of a low amount of toner held back by the doctor blade) at which application of toner to the layer by way of a metering roller and sealing brushes is resumed.

U.S. Pat. No. 3,660,863 discloses an elastomeric blade for removing a dry particulate material from a surface to which the particulate material is electrostatically bonded. An edge of the blade is supported in pressure contact against the surface in a cutting tool fashion and relative motion between the blade and the surface produced wherein the edge of the blade moves between the particulate material and the surface to cut or chisel the material from the surface.

U.S. Pat. No. 4,523,833 discloses a process cartridge for use in a printing machine. The process cartridge includes a housing having a first support surface and a second support surface. The housing further includes a first member rotatably secured to the housing at the first support surface and the second support surface. The housing further includes a second member spaced from the first member and rotatably secured to the housing at the first support surface and the second support surface. The housing further includes a first gear operably associated with the first member and rotatable therewith. The housing further includes a second gear operably associated with the second member and rotatable therewith. The first gear and the second gear are positioned adjacent the first support surface.

SUMMARY OF THE INVENTION

In accordance with one aspect of the present invention, there is provided a developer unit for developing a latent image with marking particles. The developer unit includes a housing defining a chamber for storing a supply of marking particles therein. The developer unit also includes an advancing member for advancing the marking particles on a surface thereof from the chamber of the housing in a first direction toward the latent image. The developer unit also includes a first regulating member for charging the marking particles and for regulating the thickness of the layer of marking particles on the surface of the advancing member. The developer unit also includes a second regulating member spaced from the first regulating member. The second regulating member serves to at least one of charge the layer of marking particles on the surface of the advancing member and regulate the thickness of the layer of marking particles on the surface of the advancing member. The second regulating member is adapted cooperate with the advancing member to charge the marking particles on the surface of the advancing member so as to reduce ghosting when developing the latent image with the marking particles.

In accordance with another aspect of the present invention, there is provided a process cartridge for use in a printing machine. The process cartridge includes a housing defining a chamber for storing a supply of marking particles therein. The process cartridge also includes an advancing member for advancing the marking particles on a surface thereof from the chamber of the housing in a first direction toward the latent image. The process cartridge also includes a first regulating member for charging the marking particles and for regulating the thickness of the layer of marking particles on the surface of the advancing member. The developer unit also includes a second regulating member spaced from the first regulating member. The second regulating member serves to at least one of charge the layer of marking particles on the surface of the advancing member and regulate the thickness of the layer of marking particles on the surface of the advancing member. The second regulating member is adapted cooperate with the advancing member to charge the marking particles on the surface of the advancing member so as to reduce ghosting when developing the latent image with the marking particles.

In accordance with another aspect of the present invention, there is provided a developer unit for developing a latent image with marking particles. The developer unit includes a housing defining a chamber for storing a supply of marking particles therein. The developer unit also includes an advancing member for advancing the marking particles on a surface thereof from the chamber of the housing in a first direction toward the latent image. At least a portion of the marking particles on the surface of the advancing member remain on the surface after the advancing member has advanced the marking particles toward the latent image. The developer unit also includes a charging member for charging the marking particles remaining on the surface of the advancing member after the advancing member has advanced the marking particles toward the latent image. The charging member is positioned spaced from the latent image in the first direction. The charging member is positioned spaced from the advancing member so as to rub the marking particles between the advancing member and the charging member. The rubbing of the marking particles serves to charge the marking particles. The charging of the marking particles is transferable to the advancing member so as to reduce ghosting when developing the latent image with the marking particles.

In accordance with yet another aspect of the present invention, there is provided an electrophotographic printing machine of the type including a process cartridge. The process cartridge includes a housing defining a chamber for storing a supply of marking particles therein. The process cartridge also includes an advancing member for advancing the marking particles on a surface thereof from the chamber of the housing in a first direction toward the latent image. The process cartridge also includes a first regulating member for charging the marking particles and for regulating the thickness of the layer of marking particles on the surface of the advancing member. The developer unit also includes a second regulating member spaced from the first regulating member. The second regulating member serves to at least one of charge the layer of marking particles on the surface of the advancing member and regulate the thickness of the layer of marking particles on the surface of the advancing member. The second regulating member is adapted cooperate with the advancing member to charge the marking particles on the surface of the advancing member so as to reduce ghosting when developing the latent image with the marking particles.

In accordance with yet another aspect of the present invention, there is provided a method for developing a latent image with marking particles. The method includes the steps of providing a housing defining a chamber for storing a supply of marking particles therein, advancing the marking particles with an advancing member on a surface thereof from the chamber of the housing in a first direction toward the latent image, regulating the thickness of the layer of marking particles on the surface of the advancing member and with a regulating member, charging the marking particles on the surface of the advancing member with the regulating member, transferring a portion of the marking particles from the advancing member to the latent image to form a developed image, and charging the marking particles remaining on the surface of the advancing member after the transferring step with a charging member.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 5:
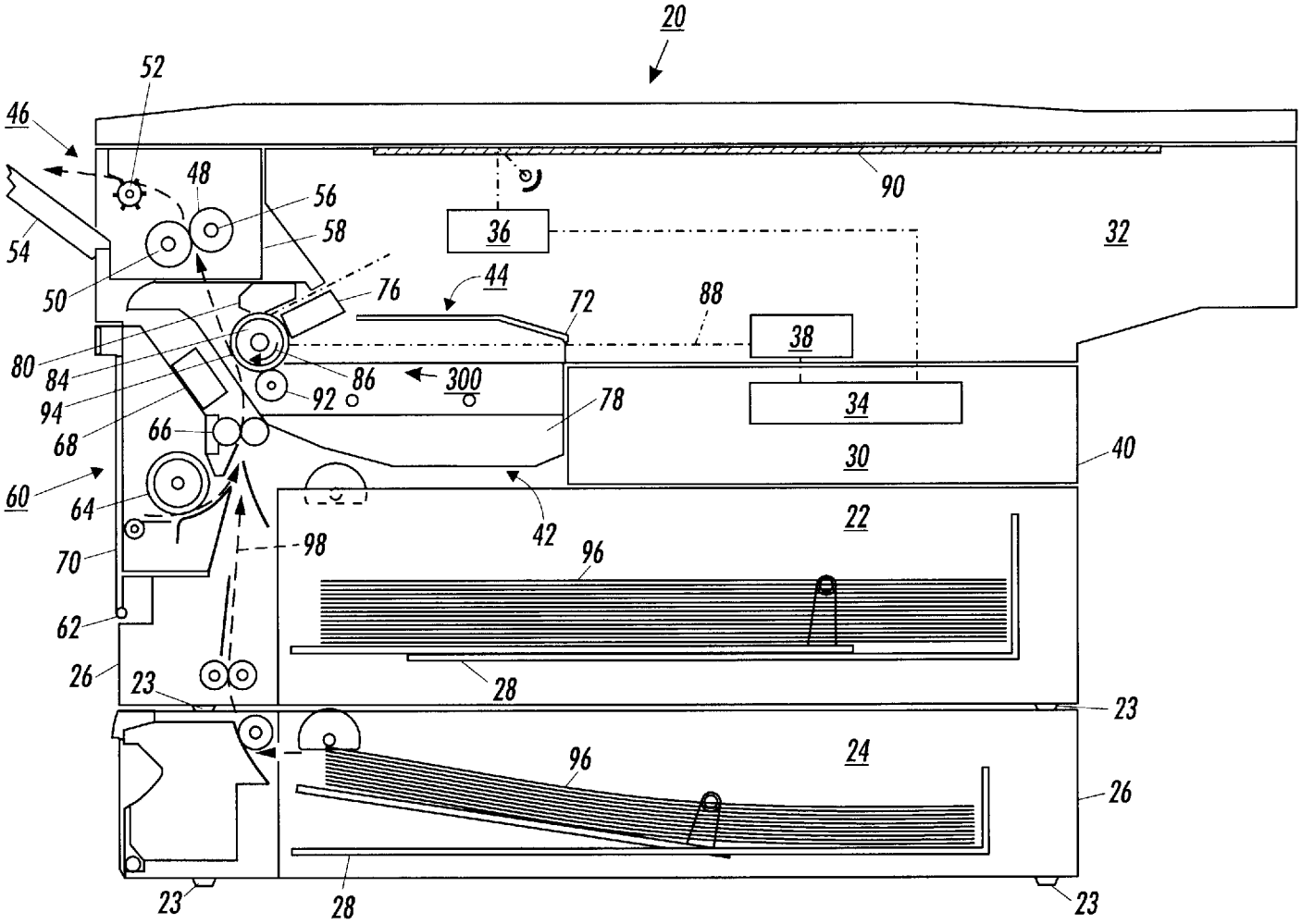
FIG. 5 is a front vertical illustration of an exemplary compact electrostatographic reproduction machine comprising separately framed mutually aligning modules in accordance with the present invention.
Figure 6:
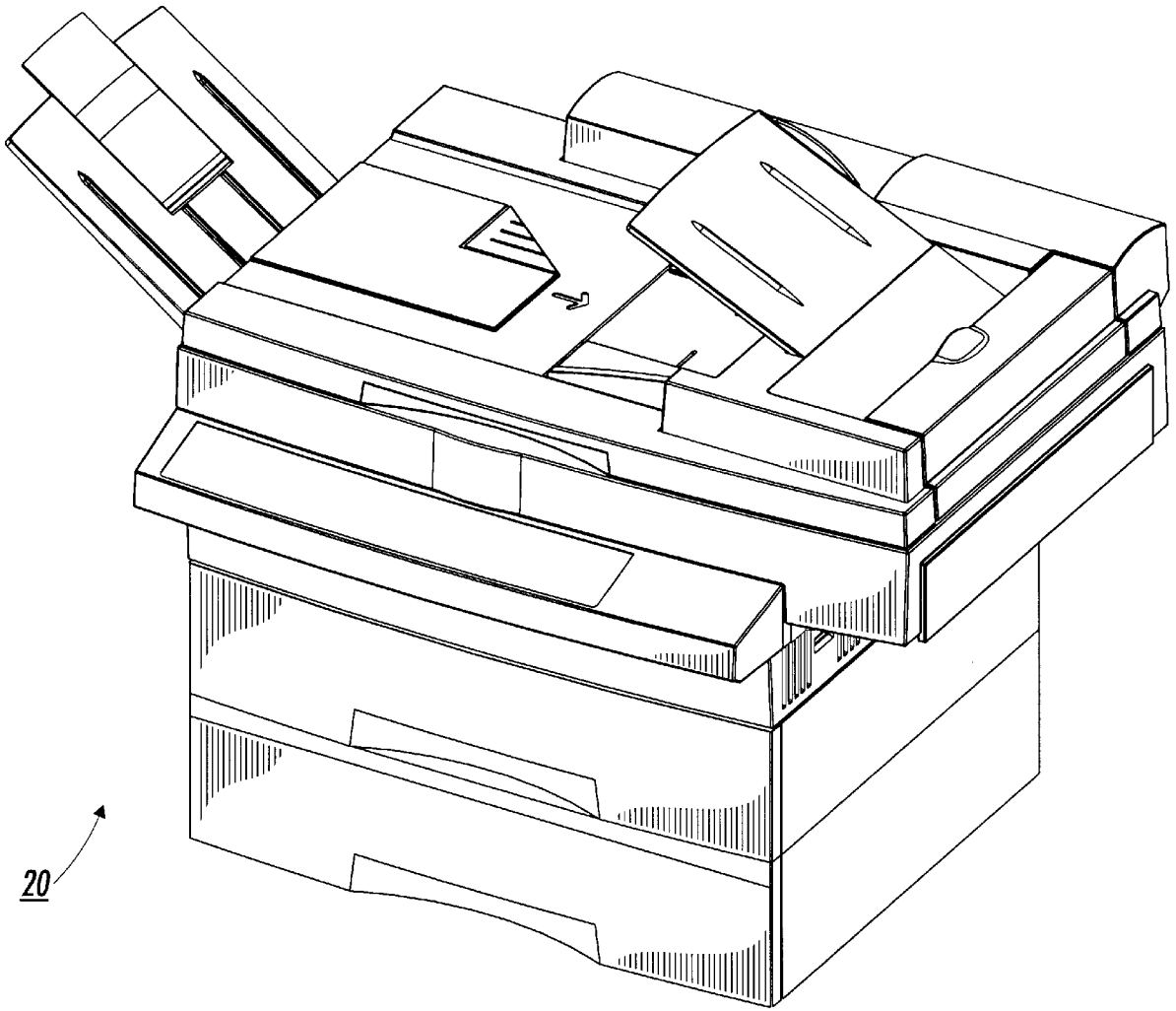
FIG. 6 is a perspective view of the machine of FIG. 5.

Referring now to FIGS. 5 and 6, there is illustrated a frameless exemplary compact electrostatographic reproduction machine 20 comprising separately framed mutually aligning modules according to the present invention. The compact machine 20 is frameless, meaning that it does not have a separate machine frame to which electrostatographic process subsystems are assembled, aligned to the frame, and then aligned relative to one another as is typically the case in conventional machines. Instead, the architecture of the compact machine 20 is comprised of a number of individually framed, and mutually aligning machine modules that variously include pre-aligned electrostatographic active process subsystems.

As shown, the frameless machine 20 comprises at least a framed copy sheet input module (CIM) 22. Preferably, the machine 20 comprises a pair of copy sheet input modules, a main or primary module the CIM 22, and an auxiliary module the (ACIM) 24, each of which has a set of legs 23 that can support the machine 20 on a surface, therefore suitably enabling each CIM 22, 24 to form a base of the machine 20. As also shown, each copy sheet input module (CIM, ACIM) includes a module frame 26 and a copy sheet stacking and lifting cassette tray assembly 28 that is slidably movable in and out relative to the module frame 26. When as preferred here, the machine 20 includes two copy sheet input modules, the very base module is considered the auxiliary module (the ACIM), and the top module which mounts and mutually aligns against the base module is considered the primary module (the CIM).

The machine 20 next comprises a framed electronic control and power supply (ECS/PS) module 30, that as shown mounts onto, and is mutually aligned against the CIM 22 (which preferably is the top or only copy sheet input module). A framed latent image forming imager module 32 then mounts over and is mutually aligned against the ECS/PS module. The ECS/PS module 30 includes all controls and power supplies (not shown) for all the modules and processes of the machine 20. It also includes an image processing pipeline unit (IPP) 34 for managing and processing raw digitized images from a Raster Input Scanner (RIS) 36, and generating processed digitized images for a Raster Output Scanner (ROS) 38. The ECS/PS module 30 also includes harnessless interconnect boards and inter-module connectors (not shown), that provide all power and logic paths to the rest of the machine modules. An interconnect board (PWB) (not shown) connects the ECS controller and power supply boards (not shown) to the inter-module connectors, as well as locates all of the connectors to the other modules in such a manner that their mating connectors would automatically plug into the ECS/PS module during the final assembly of the machine 20. Importantly, the ECS/PS module 30 includes a module frame 40 to which the active components of the module as above are mounted, and which forms a covered portion of the machine 20, as well as locates, mutually aligns, and mounts to adjacent framed modules, such as the CIM 22 and the imager module 32.

The framed copy sheet input modules 22, 24, the ECS/PS module 30, and the imager module 32, as mounted above, define a cavity 42. The machine 20 importantly includes a customer replaceable, all-in-one CRU or process cartridge module 44 that is insertably and removably mounted within the cavity 42, and in which it is mutually aligned with, and operatively connected to, the framed CIM, ECS/PS and imager modules 22, 30, 32.

As further shown, the machine 20 includes a framed fuser module 46, that is mounted above the process cartridge module 44, as well as adjacent an end of the imager module 32. The fuser module 46 comprises a pair of fuser rolls 48, 50, and at least an exit roll 52 for moving an image carrying sheet through, and out of, the fuser module 46 into an output or exit tray 54. The fuser module also includes a heater lamp 56, temperature sensing means (not shown), paper path handling baffles (not shown), and a module frame 58 to which the active components of the module, as above, are mounted, and which forms a covered portion of the machine 20, as well as locates, mutually aligns, and mounts to adjacent framed modules, such as the imager module 32 and the process cartridge module 44.

The machine then includes an active component framed door module 60 that is mounted pivotably at pivot point 62 to an end of the CIM 22. The door module 60 as mounted, is pivotable from a substantially closed vertical position into an open near-horizontal position in order to provide access to the process cartridge module 44, as well as for jam clearance of jammed sheets being fed from the CIM 22. The door module 60 comprises active components including a bypass feeder assembly 64, sheet registration rolls 66, toner image transfer and detack devices 68, and the fused image output or exit tray 54. The door module 60 also includes drive coupling components and electrical connectors (not shown), and importantly, a module frame 70 to which the active components of the module as above are mounted, and which forms a covered portion of the machine 20, as well as, locates, mutually aligns, and mounts to adjacent framed modules, such as the CIM 22, the process cartridge module 44, and the fuser module 46.

More specifically, the machine 20 is a desktop digital copier, and each of the modules 22, 24, 30, 32, 44, 48, 60, is a high level assembly comprising a self-containing frame and active electrostatographic process components specified for sourcing, and enabled as a complete and shippable product. It is believed that some existing digital and light lens reproduction machines may contain selective electrostatographic modules that are partitioned for mounting to a machine frame, and in such a manner that they could be designed and manufactured by a supplier. However, there are no known such machines that have no separate machine frame but are comprised of framed modules that are each designed and supplied as self-standing, specable (i.e. separately specified with interface inputs and outputs), testable, and shippable module units, and that are specifically crafted and partitioned for enabling all of the critical electrostatographic functions upon a simple assembly. A unique advantage of the machine 20 of the present invention as such is that its self-standing, specable, testable, and shippable module units specifically allow for high level sourcing to a small set of module-specific skilled production suppliers. Such high level sourcing greatly optimizes the quality, the total cost, and the time of delivering of the final product, the machine 20.

Referring now to FIGS. 5–8, the CRU or process cartridge module 44 generally comprises a module housing subassembly 72, a photoreceptor subassembly (not shown), a charging subassembly 76, a developer subassembly 78 including a source of fresh developer material, a cleaning subassembly 80 for removing residual toner as waste toner from a surface of the photoreceptor, and a waste toner sump subassembly (not shown) for storing waste toner. The module housing subassembly 72 of the CRU or process cartridge module 44 importantly provides and includes supporting, locating and aligning structures, as well as driving components for the process cartridge module 44.

Still referring to FIG. 5, operation of an imaging cycle of the machine 20 using the all-in-one process cartridge module 44 generally, can be briefly described as follows. Initially, a photoreceptor in the form of a photoconductive drum 84 of the customer replaceable unit (CRU) or process cartridge module 44, rotating in the direction of the arrow 86, is charged by the charging subassembly 76. The charged portion of the drum is then transported to an imaging/exposing light 88 from the ROS 38 which forms a latent image on the drum 84, corresponding to an image of a document positioned on a platen 90, via the imager module 32. It will also be understood that the imager module 32 can easily be changed from a digital scanning module to a light lens imaging module.

The portion of the drum 84 bearing a latent image is then rotated to the developer subassembly 78 where the latent image is developed with developer material such as with charged single component magnetic toner using a magnetic developer roll 92 of the process cartridge module 44. The developed image on the drum 84 is then rotated to a near vertical transfer point 94 where the toner image is transferred to a copy sheet substrate 96 fed from the CIM 22 or ACIM 22 along a copy sheet or substrate path 98. In this case, the detack device 68 of the door module 60 is provided for charging the back of the copy sheet substrate (not shown) at the transfer point 94, in order to attract the charged toner image from the photoconductive drum 84 onto the copy sheet substrate.

The copy sheet substrate with the transferred toner image thereon, is then directed to the fuser module 46, where the heated fuser roll 48 and pressure roll 50 rotatably cooperate to heat, fuse and fix the toner image onto the copy sheet substrate. The copy sheet substrate then, as is well known, may be selectively transported to the output tray 54 or to another post-fusing operation.

The portion of the drum 84 from which the developed toner image was transferred is then advanced to the cleaning subassembly 80 where residual toner and residual charge on the drum 84 are removed therefrom. The imaging cycle of the machine 20 using the drum 84 can then be repeated for forming and transferring another toner image as the cleaned portion again comes under the charging subassembly 76.

Figure 7:
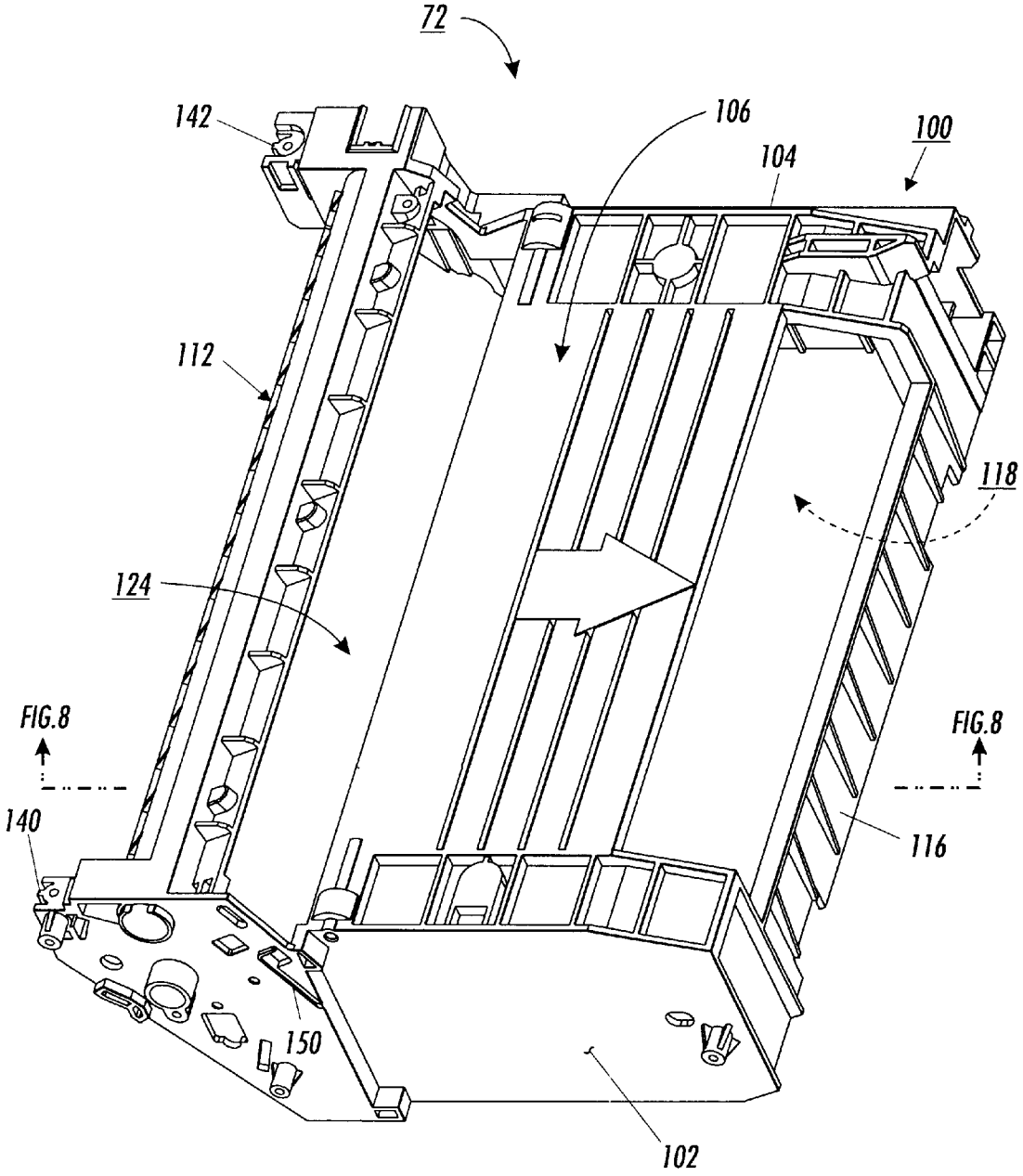
FIG. 7 is a top perspective view of the module housing of the CRU or process cartridge module of the machine of FIG. 5.
Figure 8:
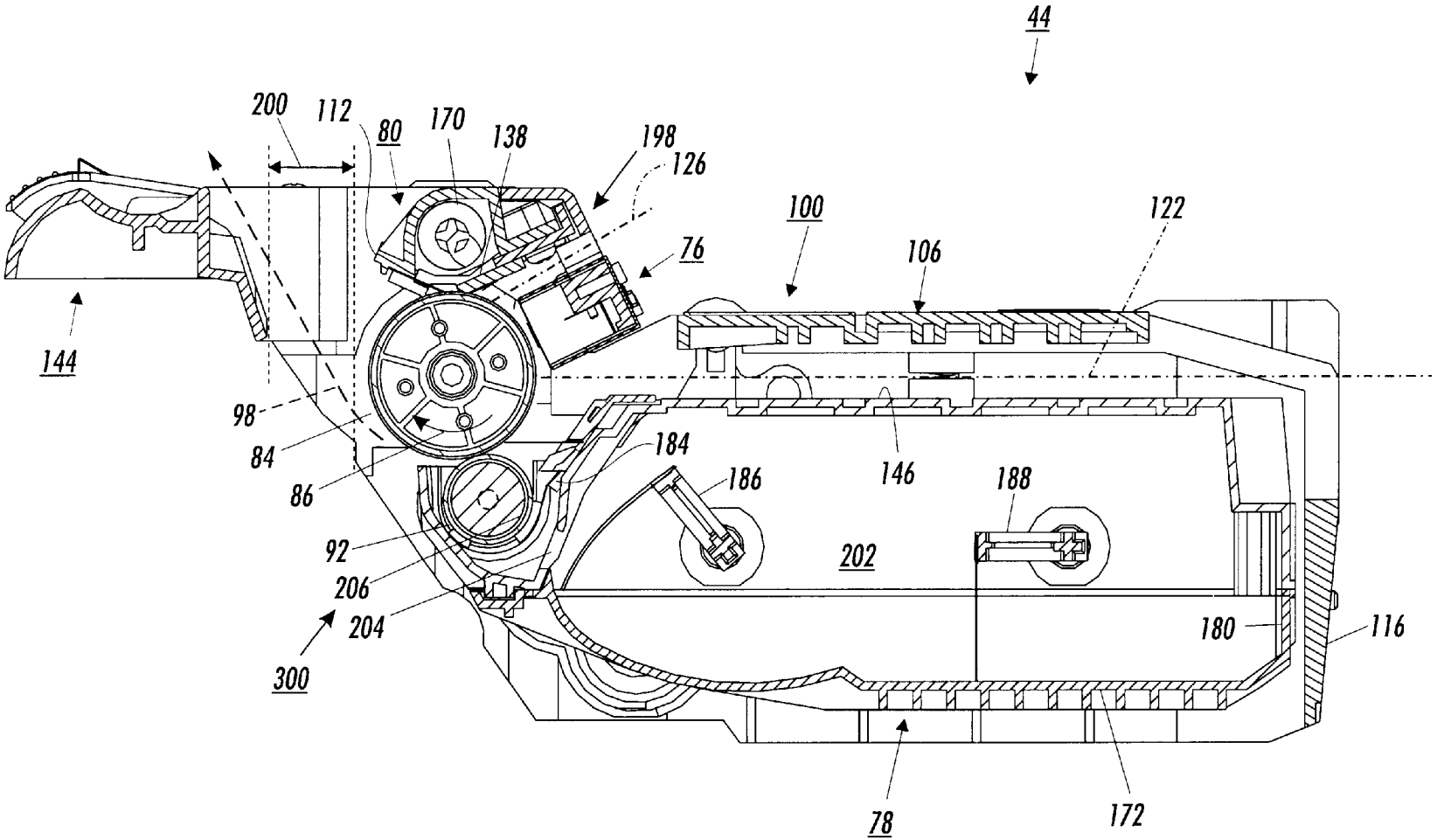
FIG. 8 is a vertical section (front-to-back) of the CRU or process cartridge module of the machine of FIG. 5.

Referring now to FIGS. 7 and 8, a vertical (rear-to-back) section of the CRU or process cartridge module 44 as viewed along the plane 8—8 of FIG. 7 is illustrated. As shown, the developer subassembly 78 is mounted within the trough region 118 of the module housing subassembly 72 as defined in part by the front end wall 116, the second side wall 104, and the top wall 106 of the module housing subassembly. The module handle 144 as attached to mounting members 140, 142, forms a portion of the sheet or paper path 98 of the machine 20 (see FIG. 5) by being spaced a distance 200 from photoreceptor 84 in the raised rear end 112 of the module housing 100. The photoreceptor or drum 84 is mounted to the side walls 102, 104, and as shown is located within the raised rear end 112 and is rotatable in the direction of the arrow 86. The charging subassembly 76 is mounted within the second cutout 124 in the top wall 106 and includes the slit 198 defining part of the second light path 126 for erase light 128 (see FIG. 5) to pass to the photoreceptor 84.

Upstream of the charging subassembly 76, the cleaning subassembly 80, including the cleaning blade 138 and the waste toner removing auger 170, is mounted within the raised rear end 112, and into cleaning contact with the photoreceptor 84. As further shown, the top wall 106 of the module housing 100 is spaced from the top 146 of the developer subassembly 78, thus defining the part of first light path 122 for the exposure light 88 from the ROS 38 (see FIG. 5). The first light path 122 is located so as to be incident onto the photoreceptor at a point downstream of the charging subassembly 76.

The front 180, top 146, and bottom member 172 of the developer subassembly define a chamber 202, having an opening 204, for containing developer material (not shown). The first and second agitators 186, 188 are shown within the chamber 202 for mixing and moving developer material towards the opening 204. The developer material biasing device 184 and a charge trim and metering blade 206 are mounted at the opening 204. As also shown, the magnetic developer roll 92 is mounted at the opening 204 for receiving charged and metered developer material from such opening, and for transporting such developer material into a development relationship with the photoreceptor 84.

According to the present invention and referring again to FIG. 5, development member 92 is shown as part of a dual charging and metering device 300. The dual charging and metering device 300 is shown as part of a process cartridge module 44 for use in a xerographic reproduction machine 20. While the xerographic reproduction machine 20 is shown in FIG. 5 is a digital printing machine utilizing a ROS (raster output scanner) it should be appreciated that the dual charging and metering device utilizing development member 92 may be utilized in a light lens machine as well. Furthermore, it should be appreciated that the dual charging and metering device of the present invention may be utilized with a development member which is part of a copying or printing machine which does not utilize a process cartridge module as shown in the xerographic reproduction machine 20 of FIG. 5.

Referring now to FIG. 8, a dual charging and metering device 300 is shown including developer roll 92. As shown in FIG. 8, the developer roll 92 is a part of the process cartridge module 44. It should be appreciated, however, that the dual charging and metering device 300 including the development roll 92 may be utilized in a xerographic machine which does not incorporate a process cartridge module.

Figure 1:
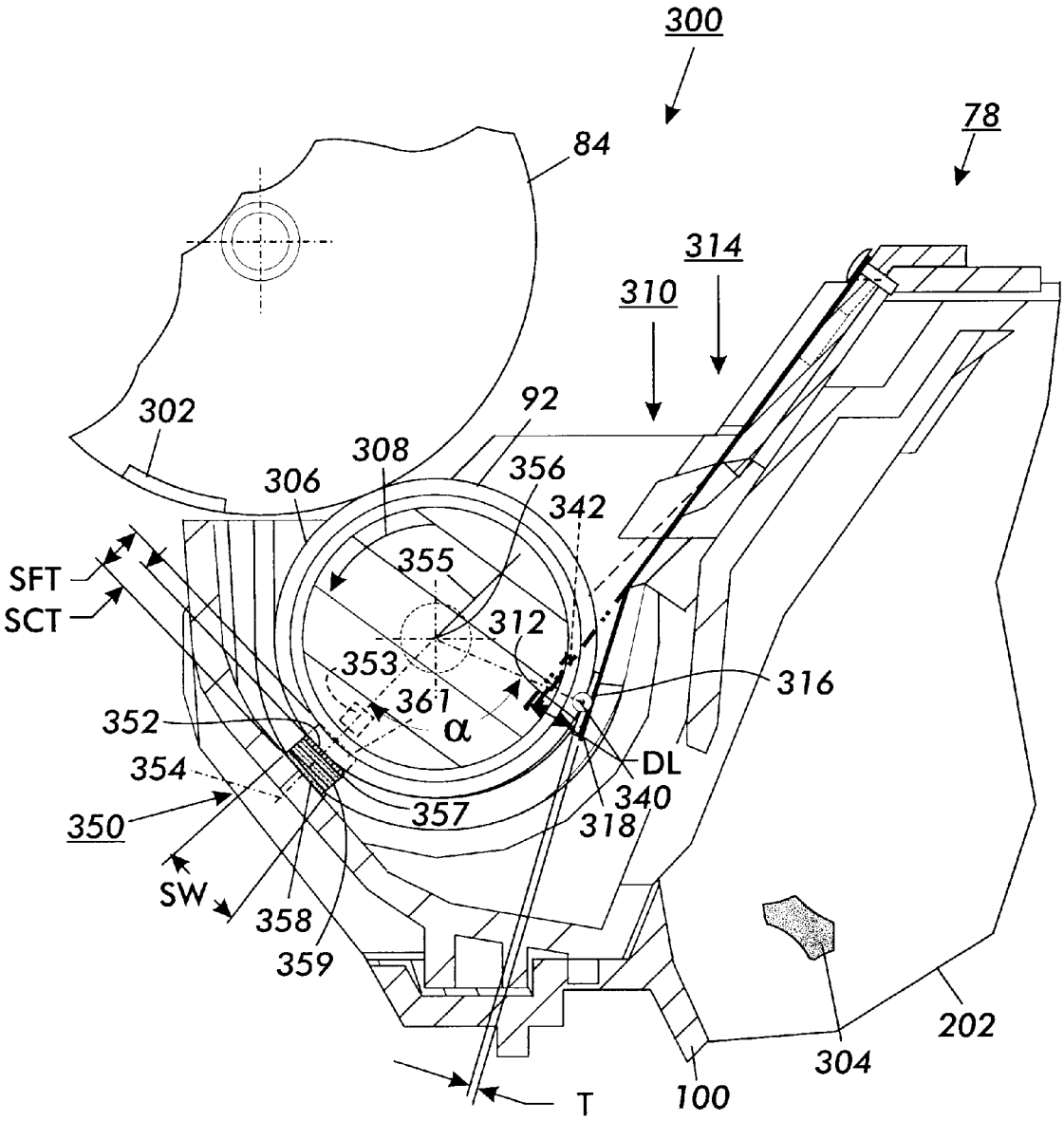
FIG. 1 is a partial enlarged view of FIG. 8 showing the magnetic roll and the two stage charging and metering of the present invention in greater detail utilizing a foam second regulating member.

Referring now to FIG. 1, the dual charge and metering device 300 is shown in greater detail. The dual charge and metering device 300 is utilized in a developer unit or developer subassembly 78. The developer subassembly 78 is utilized for developing a latent image 302 formed on a photoconductive surface, for example photoreceptor 84. The latent image 302 is developed with marking particles 304, for example in the form of developer material, for example dry toner. The dual charge and metering device 300 includes a housing 100. The housing 100 defines a chamber 202 therein for storing a supply of marking particles 304 within the chamber 202.

The developer unit 78 further includes an advancing member 92 in the form of, for example, a magnetic developer roll 92 for advancing the marking particles 304 on surface 306 of the roll 92 from the chamber 202 of the housing 100 in a first direction of arrow 308 toward the latent image 302 formed on the photoreceptor drum 84. The dual charging and metering device 300 further includes a first regulating member or a regulating member 310 for regulating the thickness of the layer of marking particles 304 on surface 306 of the magnetic developer roll 92. The regulating member 310 also serves to rub the marking particles 304 against periphery 306 of the roll 92 and to thereby charge the marking particles 304.

While the regulating member 310 may have any shape and configuration capable of regulating the thickness of the layer of marking particles 304 on the surface 306 of the magnetic developer roll 92, preferably, the first regulating member includes a free edge 312 of the regulating member 310. The free edge 312 is utilized for charging the particles 304 and for regulating the thickness of the layer of marking particles 304 on the surface 306 of the magnetic developer roll 92. During operation of the developer unit 78, the free edge 312 of the regulating member 310 is spaced a distance T from the surface 306 of the magnetic developer roll 92.

While the regulating member 310 may have any suitable shape and be made of any suitable materials capable of charging the marking particles 304 and regulating the thickness of the layer of marking particles 304 on the surface 306 of the magnetic developer roll 92, preferably, for simplicity the regulating member 310 may include a metal body 314 operably connected to the housing 100. The metal body 314 includes a free end 316 thereof. The regulating member 310 preferably also includes a plastic member 318 which is attached to the free end 316 of the metal body 314. The plastic member 318 includes the free edge 312 thereof. The free edge 312 of the plastic member 318 is spaced from the surface 306 of the magnetic developer roll 92 such that developer material may be carried by the magnetic developer roll 92 along the surface 306 thereof and such that the roll 92 and the regulating member 310 may rub the particles 304 positioned therebetween and thereby charge the marking particles 304.

Figure 2:
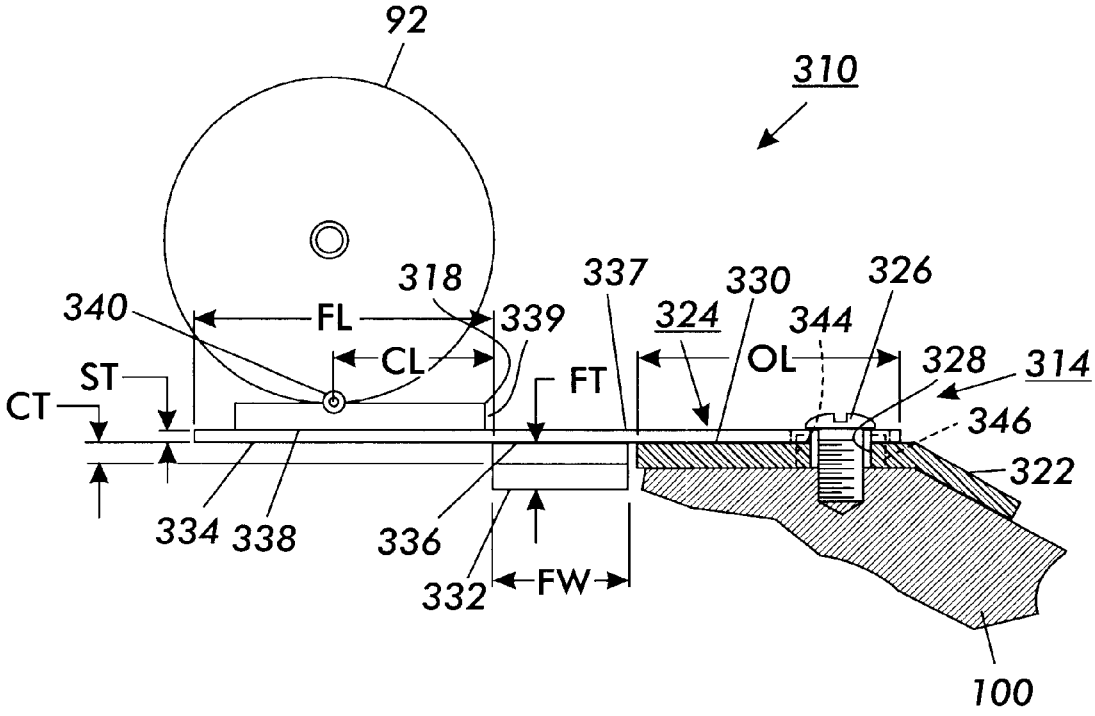
FIG. 2 is a partial enlarged view of the two stage charging and metering process cartridge module of FIG. 1 showing the first regulating member in greater detail.

Referring now to FIG. 2, the regulating member 310 is shown in greater detail. While it should be appreciated that the regulating member 310 may have any suitable shape and configuration capable of advancing the marking particles 304 toward the latent image 302, as shown in FIG. 2, the regulating member 310 includes the metal body 314 and the plastic member 318 which is attached thereto.

To provide proper pliability to the metal body 314 of the regulating member 310 and to adequately secure the metal body 314 to the housing 100, preferably, the metal body 314 includes a sheet metal portion 322 which is attached to the housing 100 and a pliable stainless steel portion 324 which is secured to the sheet metal portion 322.

The stainless steel portion 324 is secured to the sheet metal portion 322 in any suitable fashion. For example, as shown in FIG. 2, fasteners in the form of screws 326 may be fitted through clearance holes 328 located in the stainless steel portion 324 and in the sheet metal portion 322. The screws 326 are threadably attached to the housing 100.

To assure that the regulating member 310 is accurately positioned with respect to the housing 100, preferably, the sheet metal portion 322 of the metal body 314 includes location holes 344 which mate with positioning pins 346 which are integral with and extend outwardly from the housing 100.

Preferably, as shown in FIG. 2, the stainless steel portion 324 is further secured to the sheet metal portion 322 by the application of a body adhesive 330 positioned between the stainless steel portion 324 and the sheet metal portion 322. The body adhesive 330 serves to provide a more secure and complete connection between the stainless steel portion 324 and the sheet metal portion 322 so that the deflection of the plastic member 318 may be more accurately controlled. The stainless steel portion 324 preferably overlaps the sheet metal portion 322 and may overlap a distance OL of say for example, 0.40 inches.

The stainless steel portion 324 preferably is cantilevered or overhangs the sheet metal portion 322. The stainless steel portion 324 has a free length FL of say, for example, 0.70 inches and the free length FL is chosen together with the thickness ST of the stainless steel portion 324 to provide for a particular force between the roll 92 and the plastic member 318. For example, for a free length FL of 0.70 inches, the thickness ST of the stainless steel portion 324 may be, for example 0.002 inches.

Preferably, to assist in the force of the plastic member 318 against the roll 92, the regulating member 310 further includes a foam support 332. The foam support 332 is positioned on face 334 of the stainless steel portion 324 opposed to the plastic member 318. During operation, the foam support 332 is compressed against the housing 100 and further serves to provide a force for the plastic member 318 against the roll 92. The foam support may have a width FW of, for example 0.3 inches and preferably extends the length of the developer roll 92. The foam support 332 has a free thickness FT of, for example 0.125 inches and a compressed thickness during operation CT of, for example 0.05 inches. The foam support 332 may be made of any suitable synthetic foam which is not chemically reactive with the marking particles 304. The foam support 332 is secured to the stainless steel portion 324 by foam adhesive 336.

The plastic member 318 is secured to second face 337 of the stainless steel portion 324 by any suitable means. Preferably the plastic member 318 is secured to the stainless steel portion 324 by member adhesive 338. Member adhesive 338 may be any adhesive capable of securing the plastic member 318 and not being chemically reactive with the marking particles 304.

The plastic member 318 is tangentially contactable with the outer surface 306 of the magnetic developer roll at contact point 340. It should be appreciated that in operation the plastic member 318 is spaced from the roll 92 so that the marking particles 304 may be regulated and charged by passing therebetween. Contact point 340 may be for example, positioned at a distance of, for example CL from inner edge 339 of the plastic member 318 of for example 0.60 inches.

Referring again to FIG. 1, during operation, the plastic member 318 is deflected away from the magnetic developer roll 92 a distance DL from its free position 342 as shown in phantom. For example, the distance DL may be, for example 3 millimeters.

According to the present invention the dual charging and metering device 300 also includes a second regulating member or a charging member 350 spaced from the regulating member 310 in a direction opposed to the direction 308 of rotation of the roll 92. The charging member 350 is utilized to charge the marking particles 304 remaining on the surface of the magnetic developer roll 92 after a portion of the particles have been transferred to the photoconductive drum 84 to develop the latent image. The charging member 350 is adapted to charge the remaining marking particles 304 on the surface 306 of the magnetic developer roll 92 by rubbing the particles 304 between the surface 306 of the roll and the charging member 350. The charging of the particles 304 by the charging member 350 disturbs or eliminates the residual charges on the roll 92 which can otherwise accumulate on the surface of the roll 92 and may cause ghosting on a printed sheet. The eliminating of the residual charges on the roll 92 by the particles 304 charged by the charging member 350 reduces ghosting when developing the latent image 302 with the marking particles 304.

Preferably, the charging member 350 includes a free edge 352 of the regulating member 350. The free edge 352 of the charging member 350 is spaced from the surface 306 of the magnetic developer roll 350.

The charging member 350 is spaced from the regulating member 310. The charging member 350 is utilized for regulating the thickness of the layer of marking particles 304 remaining on the surface 306 of the magnetic developer roll 92 after the latent image 302 has been developed. The regulating member 310 and the charging member 350 cooperate to charge the layer of marking particles 304 on the surface 306 of the magnetic developer roll 92.

The dual charging and metering device 300 preferably includes a magnet 353 for attracting the marking particles 304 from the chamber 202 and for securing the particles 304 onto the periphery 306 of the roll 92. The magnet may be any suitable permanent magnet or permanently magnetizable material with sufficient field strength and which is not chemically reactive with the marking particles 304.

It should be appreciated that the charging member 350 may be spaced from the regulating member 310 any distance which is sufficient to provide for charging of the marking particles 304 on the surface 306 of the roll 92. Preferably, however, the charging member is positioned with respect to the regulating member 310 such that center line 354 of the charging member 350 is positioned proximate to radial pole 355 of the magnet 353. The magnetic field of the magnet 353 at the radial pole 355 aligns the marking particles 304 trapped between the charging member and the roll 92 to more effectively charge the particles 304.

For example, for the device 300 of FIG. 1, the charging member 350 is positioned at an angle at an angle cc about center line 356 of the magnetic developer roll 92 from contact point 340 of the plastic member 318 of the regulating member 310 of for example, 90°. Preferably the charging member may be positioned at an angle $\alpha$ of from for example, 20° to 290° in a direction opposed to arrow 308 from the regulating member 310.

The charging member 350 may be made of any suitable material capable of charging marking particles 304 remaining on the surface 306 of the roll 92 so as to reduce ghosting when developing the latent image with marking particles 304. Preferably, however, the charging member 350 may be in the form of a plastic sheet 357 secured to a foam base 359. The base 359 serves to support the sheet 357 and to urge the sheet 357 against the roll 92. The base 359 may be made of any suitable foam, either synthetic or natural, which is not chemically reactive with the marking particles 304. The sheet 35 may be made of any material not chemically reactive and may for example be made of Mylar.

The charging member 350 may have any suitable shape. The charging member 350 preferably extends the entire working length of the roll 92. For example, the charging member 350 may have a generally rectangular shape defined by a width SW of for example, 4 millimeters, and a free thickness SFT as shown in phantom as shape 361 of for example, 3 millimeters, and a compressed thickness SCT of for example, 2½ to 2 millimeters. The charging member 350 may be secured to housing 100 by any suitable means. For example, the charging member 350 may be secured to the housing 100 by means of second regulating adhesive 358. The adhesive 358 may be any adhesive suitable to secure the member 350 and not chemically reactive with the marking particles 304.

Figure 3:
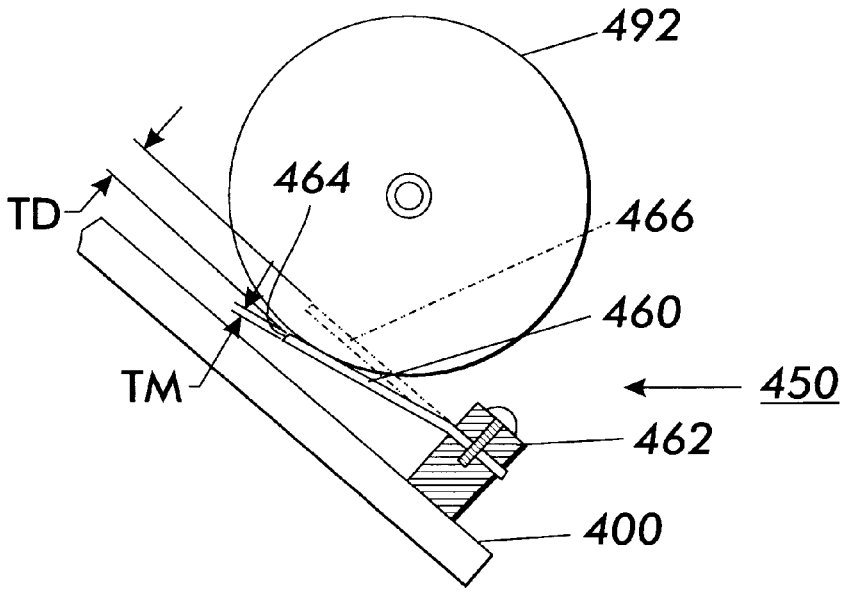
FIG. 3 is a partial view of a process cartridge module showing a second embodiment of the two stage charging and metering of the present invention utilizing a blade type second regulating member.

According to the present invention and referring now to FIG. 3, an alternate embodiment of the charging member is shown as charging member 450. Charging member 450 is in the form of a flexible blade 460 secured by clamping mechanism 462. The blade 460 preferably extends the working length of the roll 92. The blade 460 includes a free edge 464 thereof which is deflected a distance TD of for example, 3 millimeters from undeflected position 466 as marked in phantom. The deflection TD as well as the thickness TM of the blade 460 is selected to provide for sufficient rubbing of the marking particles 304 between the blade 460 and the magnetic developer roll 492 to effectively charge the particles 304. For a Mylar blade 460 having a deflection TD of 3 millimeters the blade 460 may have a thickness TM of, for example, 0.02 to 0.05 inches.

Figure 4:
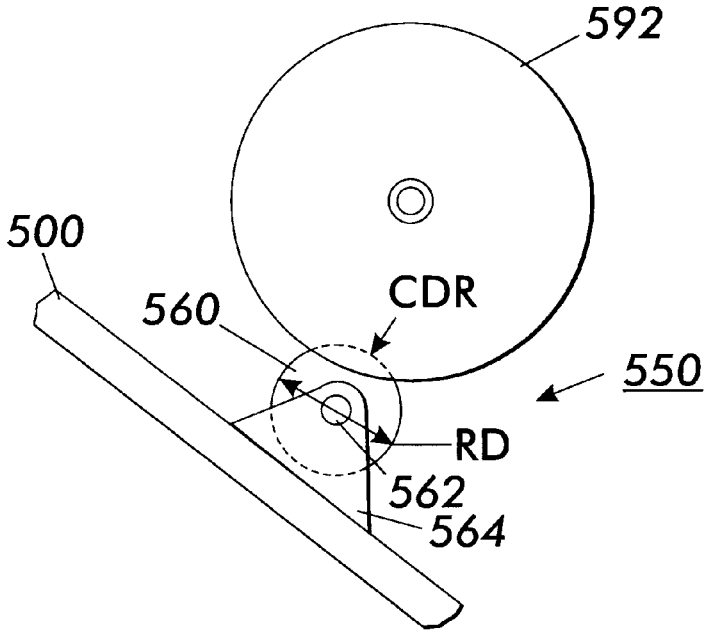
FIG. 4 is a partial view of a process cartridge module showing another embodiment of the two stage charging and metering of the present invention utilizing a roller type second regulating member.

Referring now to FIG. 4, another altered embodiment of the dual charge and metering device charging member is shown as charging member 550. Charging member 550 is in the form of a roll. For example, the member 550 includes a foam roller 560. The foam roller 560 may be made of any suitable, durable, natural, or synthetic foam which is not chemically reactive with the marking particles 304. The roller 560 may for example, be supported by a centrally located shaft 562 connected by supports 564 to housing 500. The roller 560 extends generally the length of the roll 592 and is compressed sufficiently to permit the proper mount of marking particles 304 to pass between the roll 592 and the member 550. For example, the roller 560 may have a roller diameter RD of for example, 5 millimeters, in an uncompressed state and may be compressed a distance CDR of for example, 1 millimeter.

Figure 9:
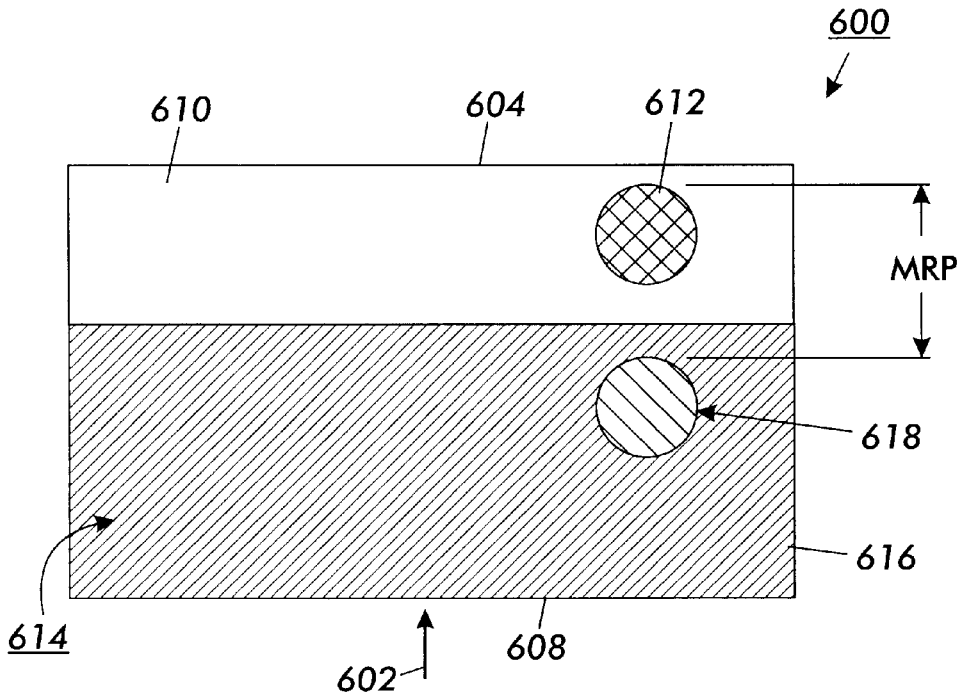
PRIOR ART FIG. 9
FIG. 9 is a schematic representation of a sheet of paper onto which a solid circle and a half toned area being sequentially printed from the same peripheral area of a development roll with out the two stage charging and metering of the present invention.

Referring now to FIG. 9, a substrate 600 in the form of a sheet is shown which has been developed by a prior art developer unit which is affected by ghosting. The sheet 600 has been developed on a developer unit with the sheet 600 being advanced in the direction of arrow 602 from the top portion 604 to the bottom portion 608 of the sheet 600. Thus, the sheet 600 has a first upper portion 610 in which a dark area 612 is first developed. The developer roll (not shown) cooperates with area 610 in which no toner particles are transferred to the sheet 600 and a second area 612 in which many marking particles are transferred to obtain the dark area as shown in FIG. 9. Since the area of sheet 600 includes the white area 610 as well as a concentrated dark area 612, the transfer of charge by the marking particles onto the magnetic roll is not uniform. In fact, toner remaining after transfer on the area on the magnetic roll corresponding to dark area 612 has considerably less charge than that on the remaining area of the magnetic roll. This phenomenon is caused because a significantly greater amount of charge is required to be transferred onto the sheet 600 at the dark area 612.

Figure 11:
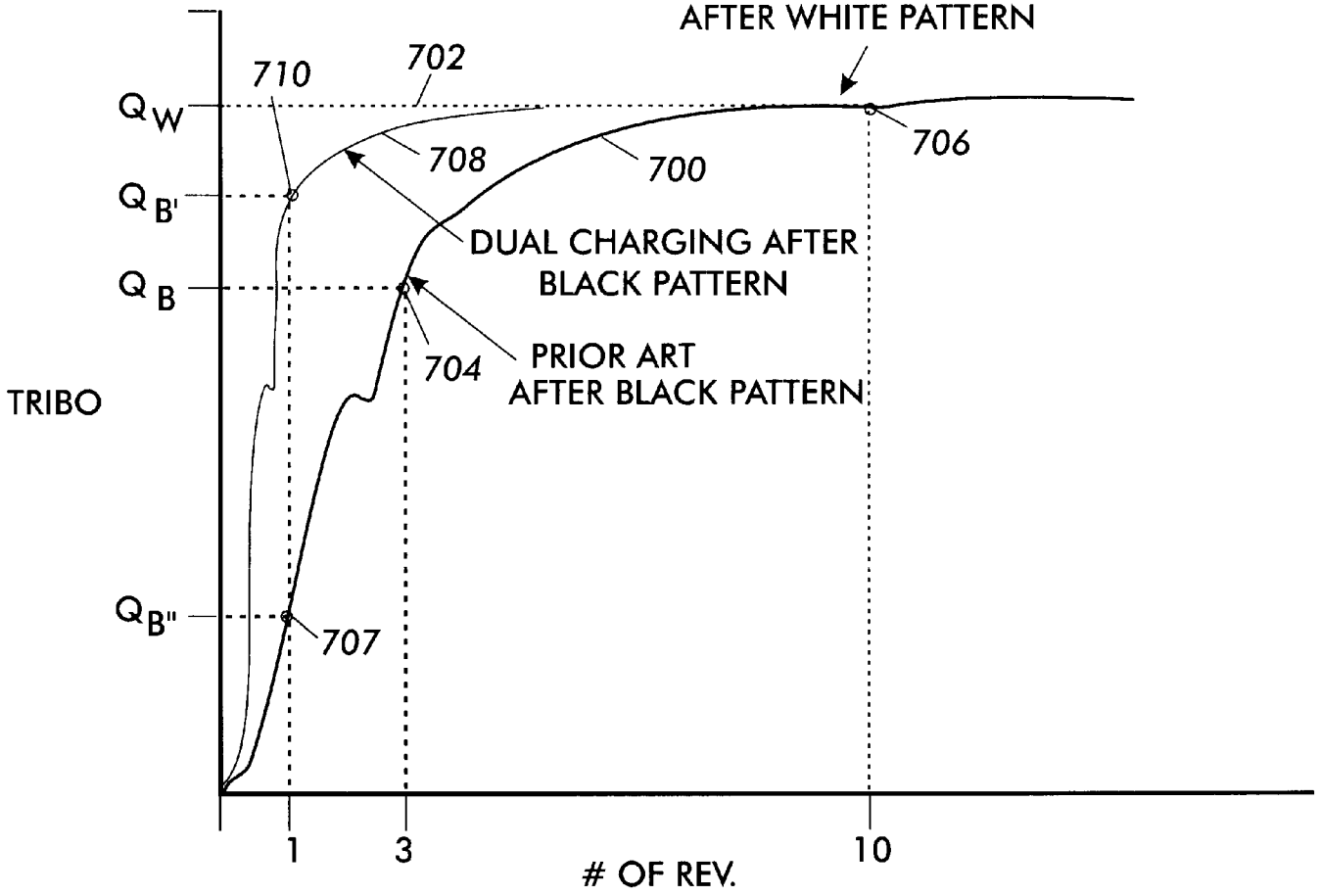
FIG. 11 is a graph of the triboelectric charging versus the number of revolutions of the magnetic roll after making copies with a white, text type, pattern, after making copies on a prior art developer unit with a black, solid type, pattern and after making copies on a developer unit according to the present invention with a black, solid type, pattern.

Referring now to FIG. 11, the tribo (charge per unit mass) is plotted in the ordinate axis with respect to the number of revolutions plotted in the abscissa axis. The first curve 700 shows experimental data of the number of revolutions of the developer roll with respect to the tribo charge for a prior art charging system. Dotted line 702 shows that the toner on the developer roll has a charge QW of, for example, 7 coulombs per gram when fully charged. This fully charged toner remains on the roll after the developing of a white pattern where no toner is transferred to the paper.

The first curve 700 shows the charge on the developer roll after a black pattern is applied to a sheet based verses the number of revolutions of the developer roll after the black pattern is applied to the sheet. At point 704 for example, which corresponds to 3 revolutions of the developer roll after the development of the black pattern, the charge QB of the area of the developer roll in which the black pattern was exposed represents a charge of for example 5 coulombs per gram. The charge of 5 coulombs per gram represents the minimum charge of marking particles on the roll to have minimally acceptable hosting on subsequent sheets. Thus in his prior art development system, unacceptable ghosting would occur for the first two revolutions of the developer roll after solid area development.

At graph point 706 which represent 10 revolutions of the developer roll after the development of the black pattern, the charge on the area of the developer roll in which the black pattern had been developed the charge QW of 7 coulombs per gram at which ghosting would no longer present. Thus, as shown in FIG. 11, if a prior art developer unit develops a black pattern on a substrate, the charge on the corresponding part of the developer roll has a below normal charge for, as shown in FIG. 11, up to 10 revolutions of the developer roll until newly charged toner upon the developer roll eliminates the residual charges on the developer roll.

Referring again to FIG. 9, the affect of tribo below that of QW as shown in FIG. 11, is graphically shown as the effect of ghosting on a subsequent half-tone portion 614 of sheet 600. For example, as shown in FIG. 9, the sheet 600 further includes a second subsequent portion 614 which includes a half-tone pattern area 616. While the whole lower area 614 should have the half-tone patter 616, the portion 618 which corresponds to the dark area 612 of the sheet 600. The portion 618 is a distance MRP or one magnetic roll pitch from portion 612. The distance MRP corresponds to the circumference of the developer roll. The portions 612 and 618 correspond to the portion of the developer roll where the charge on the developer roll is less than the remainder of the developer roll. Because of the lower charge on the ghosting area 618, the exposure of the lower area 614 which should appear as the half-tone patter 616 has a light or less developed area 618 which has been defined as ghosting.

According to the present invention and referring again to FIG. 1, as the magnetic developer roll 92 rotates in the direction of arrow 308, the magnet 353 draws marking particles 304 toward the roll 92. The outer periphery 306 of the roll 92 advances to marking particles 304 in the direction of arrow 308 toward the regulating member 310. The marking particles 304 are urged between the roll and the regulating member 310 thereby regulating the thickness of the layer of particles 304. The particles 304 are rubbed by the regulating member 310 against the roll 92 and thereby charged. The periphery 306 of the roll 92 then advances the marking particles 304 in the direction of arrow 308 toward the latent image 302 on the drum 84. A portion of the particles 304 are transferred to the latent image on the drum 84 and a portion of the particles 304 remain on the periphery 306 of the roll 92. The outer periphery 306 of the roll 92 then advances the remaining marking particles 304 in the direction of arrow 308 toward charging member 350. The remaining marking particles 304 are urged between the roll 92 and the charging member 350. The remaining particles 304 are rubbed by the charging member 350 against the roll 92 and thereby charged. As the magnetic developer roll 92 rotates further in the direction of arrow 308, the magnet 353 draws new marking particles 304 toward the roll 92 which meet with the charged particles that remained on the roll 92 and the process is repeated.

Referring again to FIG. 11, the graph 700 includes a second curve 708 which represents the charge of the remaining particles on the roll under a two-stage charging and metering system of the present invention. As can be seen in FIG. 11, the second curve 708 is significantly different than the first curve 700 of the prior art development system. For example, referring to graph point 710, the charge after a black pattern of one revolution has a charge QB' which is equal to approximately 6½ coulombs per gram. The charge QB' of 6½ coulombs per gram is significantly greater than (referring to graph point 707) the charge QB" of approximately 1½ coulombs per gram for the prior art charging system. The charge of 6½ grams per coulomb is greater than the charge of five coulombs per gram required to avoid unacceptable ghosting. Thus it can be shown that the two stage charging metering device greatly improves the charge on the marking particles 304 positioned on the developer roll after the exposure of a black pattern onto a roll and eliminates unacceptable ghosting of subsequent print areas on sheets.

Figure 10:
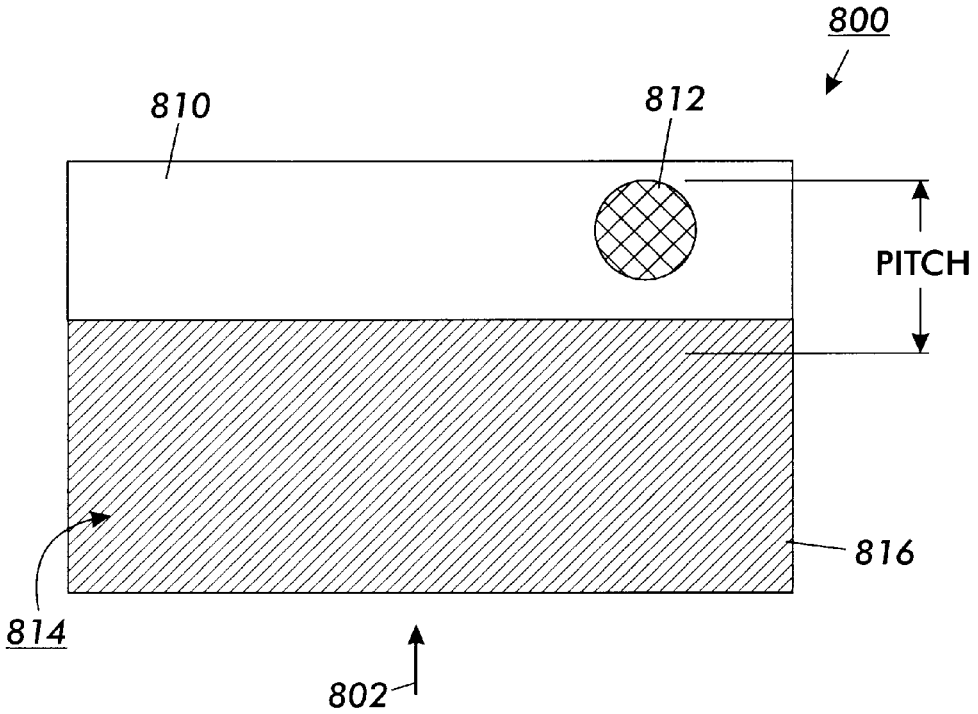
FIG. 10 is a schematic representation of a sheet of paper onto which a solid circle and a half toned area being sequentially printed from the same peripheral area of a development roll with the two stage charging and metering of the present invention.

Referring now to FIG. 10, a sheet 800 is shown including a dark area 812 within white area 810 utilizing the two-stage charging and metering system of the present invention. As the sheet 800 is advanced in the direction of arrow 802, a second portion 814 of the sheet 600 having a half-tone pattern 816 is shown. It should be appreciated that the second portion 814 of the sheet 600 is not affected by the dark area 812 because the marking particles have been recharged through the use of the charging member of the dual charging metering device of the present invention.

By providing a dual charge developer unit including a charging member for recharging upon the marking particles remaining on the roll after development, a latent image may be developed on a substrate with reduced ghosting By providing a dual charging developer unit with a first regulating member and including a metal body and a plastic member on the free end thereof in addition to a charging member for recharging upon the marking particles remaining on the roll after development, a latent image may be provided with reduced ghosting.

By providing a charging member including a Mylar blade for recharging upon the marking particles remaining on the roll after development, a latent image may be provided with reduced ghosting.

By providing a charging member including a foam member spaced from a first regulating member for recharging upon the marking particles remaining on the roll after development, a latent image may be provided with reduced ghosting.

By providing a charging member including a foam roll spaced from a first regulating member for recharging upon the marking particles remaining on the roll after development, a latent image may be developed with reduced ghosting.

By providing a dual charge developer unit including a first regulating member and a charging member for recharging upon the marking particles remaining on the roll after development, ghosting of a subsequent image developed on the latent image may be reduced.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

We claim:

1. A developer unit for developing a latent image with marking particles, said developer unit comprising:

a housing defining a chamber for storing a supply of marking particles therein;

an advancing member for advancing the marking particles on a surface thereof from the chamber of said housing in a first direction toward the latent image, said advancing member including a magnet operably associated therewith for attracting the marking particles thereto, said magnet defining a radial pole thereof;

a first regulating member for charging the marking particles and for regulating the thickness of the layer of marking particles on the surface of said advancing member; and a second regulating member spaced from said first regulating member for at least one of charging the layer of marking particles on the surface of said advancing member and for regulating the thickness of the layer of marking particles on the surface of said advancing member, said second regulating member being positioned in alignment with the radial pole of said magnet, said second regulating member adapted cooperate with the advancing member to charge the marking particles on the surface of said advancing member so as to reduce ghosting when developing the latent image with the marking particles.

2. A developer unit as claimed in claim 1, wherein said first regulating member comprises a free edge thereof for regulating the thickness of the layer of marking particles on the surface of said advancing member, the free edge of said first regulating member being spaced from the surface of said advancing member, the free edge of said first regulating member being spaced from the surface of said advancing member so as to rub marking particles positioned therebetween, the rubbing of the marking particles thereby charging the marking particles.

3. A developer unit as claimed in claim 1, wherein said second regulating member comprises a free edge thereof, the free edge of said second regulating member being spaced from the surface of said advancing member so as to rub marking particles positioned therebetween, the rubbing of the marking particles thereby charging the marking particles.

4. A developer unit as claimed in claim 1:

wherein said advancing member comprises a development roller rotatable in a first direction; and wherein said second regulating member is positioned 20 to 290 degrees from said first regulating member in a second direction opposed to the first direction.

5. A developer unit as claimed in claim 1:

wherein said advancing member comprises a development roller rotatable in a first direction;

wherein the chamber of said housing is in communication with a first position on an outer periphery of said development roller;

wherein said first regulating member is positioned adjacent a second position on the outer periphery of said development roller spaced from the first position in the first direction wherein said developer unit is adapted to transfer the marking particles to the latent image at a third position on the outer periphery of said development roller spaced from the second position in the first direction; and wherein said second regulating member is positioned adjacent a fourth position on the outer periphery of said development roller spaced from the third position in the first direction and spaced from the first position in a second direction opposed to the first direction.

6. A developer unit as claimed in claim 1, wherein said second regulating member comprises a polyester film blade.

7. A developer unit as claimed in claim 1, wherein said second regulating member comprises foam.

8. A process cartridge for use in a printing machine comprising, said process cartridge including:

a housing defining a chamber for storing a supply of marking particles therein;

an advancing member for advancing the marking particles on a surface thereof from the chamber of said housing in a first direction toward the latent image, said advancing member including a magnet operably associated therewith for attracting the marking particles thereto, said magnet defining a radial pole thereof;

a first regulating member for charging the marking particles and for regulating the thickness of the layer of marking particles on the surface of said advancing member; and a second regulating member spaced from said first regulating member for at least one of charging the layer of marking particles on the surface of said advancing member and for regulating the thickness of the layer of marking particles on the surface of said advancing member, said second regulating member being positioned in alignment with the radial pole of said magnet, said second regulating member adapted cooperate with the advancing member to charge the marking particles on the surface of said advancing member so as to reduce ghosting when developing the latent image with the marking particles.

9. A process cartridge as claimed in claim 8, wherein said first regulating member comprises a free edge thereof for regulating the thickness of the layer of marking particles on the surface of said advancing member, the free edge of said first regulating member being spaced from the surface of said advancing member, the free edge of said first regulating member being spaced from the surface of said advancing member so as to rub marking particles positioned therebetween, the rubbing of the marking particles thereby charging the marking particles.

10. A process cartridge as claimed in claim 8, wherein said second regulating member comprises a free edge thereof, the free edge of said second regulating member being spaced from the surface of said advancing member so as to rub marking particles positioned therebetween, the rubbing of the marking particles thereby charging the marking particles.

11. A process cartridge as claimed in claim 8:

wherein said advancing member comprises a development roller rotatable in a first direction; and wherein said second regulating member is positioned 20 to 290 degrees from said first regulating member in a second direction opposed to the first direction.

12. A process cartridge as claimed in claim 8:

wherein said advancing member comprises a development roller rotatable in a first direction;

wherein the chamber of said housing is in communication with a first position on an outer periphery of said development roller;

wherein said first regulating member is positioned adjacent a second position on the outer periphery of said development roller spaced from the first position in the first direction;

wherein said process cartridge is adapted to transfer the marking particles to the latent image at a third position on the outer periphery of said development roller spaced from the second position in the first direction; and wherein said second regulating member is positioned adjacent a fourth position on the outer periphery of said development roller spaced from the third position in the first direction and spaced from the first position in a second direction opposed to the first direction.

13. A process cartridge as claimed in claim 8, wherein said second regulating member comprises a polyester film blade.

14. A developer unit for developing a latent image with marking particles, said developer unit comprising:

a housing defining a chamber for storing a supply of marking particles therein;

an advancing member for advancing the marking particles on a surface thereof from the chamber of said housing in a first direction toward the latent image, said advancing member including a magnet operably associated therewith for attracting the marking particles thereto, the magnet defining a radial pole, at least a portion of the marking particles on the surface of the advancing member remaining on the surface after said advancing member has advanced the marking particles toward the latent image; and a charging member for charging the marking particles remaining on the surface of said advancing member after said advancing member has advanced the marking particles toward the latent image, said charging member being positioned spaced from the latent image in the first direction, said charging member being positioned spaced from the advancing member so as to rub the marking particles between the advancing member and the charging member, the rubbing of the marking particles adapted so as to charge the marking particles, the charging of the marking particles being transferable to the advancing member so as to reduce ghosting when developing the latent image with the marking particles.

15. An electrophotographic printing machine of the type including a process cartridge comprising:

a housing defining a chamber for storing a supply of marking particles therein;

an advancing member for advancing the marking particles on a surface thereof from the chamber of said housing in a first direction toward the latent image, said advancing member including a magnet operably associated therewith for attracting the marking particles thereto, said magnet defining a radial pole thereof;

a first regulating member for charging the marking particles and for regulating the thickness of the layer of marking particles on the surface of said advancing member; and a second regulating member spaced from said first regulating member for at least one of charging the layer of marking particles on the surface of said advancing member and for regulating the thickness of the layer of marking particles on the surface of said advancing member, said second regulating member being positioned in alignment with the radial pole of said magnet, said second regulating member adapted cooperate with the advancing member to charge the marking particles on the surface of said advancing member so as to reduce ghosting when developing the latent image with the marking particles.

16. A printing machine as claimed in claim 15, wherein said first regulating member comprises a free edge thereof for regulating the thickness of the layer of marking particles on the surface of said advancing member, the free edge of said first regulating member being spaced from the surface of said advancing member, the free edge of said first regulating member being spaced from the surface of said advancing member so as to rub marking particles positioned therebetween, the rubbing of the marking particles thereby charging the marking particles.

17. A printing machine as claimed in claim 15, wherein said second regulating member comprises a free edge thereof, the free edge of said second regulating member being spaced from the surface of said advancing member so as to rub marking particles positioned therebetween, the rubbing of the marking particles thereby charging the marking particles.

18. A printing machine as claimed in claim 15:

wherein said advancing member comprises a development roller rotatable in a first direction; and wherein said second regulating member is positioned 20 to 290 degrees from said first regulating member in a second direction opposed to the first direction.

19. A printing machine as claimed in claim 15:

wherein said advancing member comprises a development roller rotatable in a first direction;

wherein the chamber of said housing is in communication with a first position on an outer periphery of said development roller;

wherein said first regulating member is positioned adjacent a second position on the outer periphery of said development roller spaced from the first position in the first direction;

wherein said process cartridge is adapted to transfer the marking particles to the latent image at a third position on the outer periphery of said development roller spaced from the second position in the first direction; and wherein said second regulating member is positioned adjacent a fourth position on the outer periphery of said development roller spaced from the third position in the first direction and spaced from the first position in a second direction opposed to the first direction.

20. A printing machine as claimed in claim 15, wherein said second regulating member comprises a polyester film blade.

* * * * *